US007740553B2

(12) United States Patent
Salomon et al.

(10) Patent No.: US 7,740,553 B2
(45) Date of Patent: Jun. 22, 2010

(54) DETACHABLE FEED TRAY WITH SELF ADJUSTING SIDE GUIDES

(75) Inventors: James A. Salomon, Cheshire, CT (US); Donald Surprise, Waterbury, CT (US); Christopher D. Clark, Lempster, NH (US)

(73) Assignee: Pitney Bowes Inc., Stamford, CT (US)

( * ) Notice: Subject to any disclaimer, the term of this patent is extended or adjusted under 35 U.S.C. 154(b) by 1447 days.

(21) Appl. No.: 11/123,617

(22) Filed: May 6, 2005

(65) Prior Publication Data

US 2006/0252590 A1 Nov. 9, 2006

(51) Int. Cl.
*B65H 1/00* (2006.01)
*F16H 7/08* (2006.01)

(52) U.S. Cl. ..... 474/111; 271/171

(58) Field of Classification Search ..... 474/101, 474/109, 111, 140; 271/171
See application file for complete search history.

(56) References Cited

U.S. PATENT DOCUMENTS

| | | | | |
|---|---|---|---|---|
| 4,718,148 | A | 1/1988 | McKernon et al. | |
| 4,763,166 | A | 8/1988 | Watanabe et al. | |
| 5,494,272 | A * | 2/1996 | Golicz | 271/3.03 |
| 5,730,674 | A * | 3/1998 | Ott | 474/111 |
| 6,073,925 | A * | 6/2000 | Sato | 271/171 |
| 6,279,900 | B1 * | 8/2001 | Yamagishi | 271/240 |
| 6,332,610 | B1 | 12/2001 | Hiura | |
| 6,793,215 | B2 | 9/2004 | Salomon | 271/171 |
| 2002/0036682 | A1 | 3/2002 | Johnson | |
| 2003/0230846 | A1 | 12/2003 | Asakawa et al. | |

FOREIGN PATENT DOCUMENTS

| | | |
|---|---|---|
| EP | 0945378 A | 9/1999 |
| JP | 61160338 | 7/2006 |
| WO | WO 03/104047 B | 12/2003 |

* cited by examiner

*Primary Examiner*—Robert A Siconolfi
*Assistant Examiner*—Anna Momper
(74) *Attorney, Agent, or Firm*—Steven Shapiro; Angelo N. Chaclas

(57) ABSTRACT

A method and mechanism are provided for controlling the movement of a belt. The arrangement may have a moveable member is coupled to an adjustable member. The members are coupled such that when the moveable member is moved in a first direction the adjustable member is move in a first direction and when the moveable member is moved in a second direction the adjustable member is moved in a second direction. A belt is coupled to the movable member. Movement of the belt in a first direction moves the moveable member in the first direction and movement of said belt in a second direction moves the moveable member in the second direction. A belt tensioner mechanism is connected to the belt so that when the belt moves in the first direction a biasing force is created that drives said belt to move a controlled amount in the second direction when movement of the belt in the first direction is stopped. The arrangement may be employed with a materials feed tray. Side guides for the tray are automatically set correctly for proper feeding from the tray without jamming, skew or off set of the materials.

5 Claims, 2 Drawing Sheets

DETACHABLE FEED TRAY WITH SELF ADJUSTING SIDE GUIDES

FIELD OF THE INVENTION

The present invention relates to paper handling systems, such as, printers, folders or inserter systems, and more particularly to a detachable feed tray arrangement with self adjusting side guides.

BACKGROUND OF THE INVENTION

The adjustment of side guides for materials such as envelope and sheet feeders is critical for a feeder to function properly. Improperly set side guides can cause failure to feed when guides are adjusted too tightly, so that they pinch the materials. Leaving guides set too loosely can cause skew and offset problems with the materials as they are moved toward the feed head of the equipment. Typically, the operator needs to set the side guides in a feeder tray based on experience, trial and error and the feel of the adjustment; not too tight, so that materials fails to feed, and not too loose so that materials are not guided properly. Failing to constrain the materials properly can lead to problems in paper handling equipment including insertion, folding and printing errors due to excessive skew and offset. Existing methods to resolve this problem have included specific procedures and visual aids to insure that a reasonable gap is set between the guides and the stack of materials.

One arrangement for an adjustable side guide is disclosed in U.S. Pat. No. 6,793,215 B2 for SELF-ADUSTING SIIDE GUIDE FOR A MAIL HANDLING DEVICE. A self-adjusting guide is provided for a document handling machine having a feed deck along which documents are transported. The self adjusting side guide includes a member mounted for movement along the feed deck toward and away form the documents. A side guide self adjusts to correct the drag effect problem.

SUMMARY OF THE INVENTION

The present invention provides a belt tensioner for a belt used in a mechanism to position an adjustable member. The arrangement keeps the belt sufficiently tight to prevent the adjustable member from moving after the adjustable member is set. The present invention also ensures that the adjustable member is set correctly by automatically moving the adjustable member a controlled amount after the adjustable member is moved to a position.

The present invention can be employed to simplify the side guide setting process by eliminating the need for an operator to "back off" the side guides from the materials being fed from a feed tray. This back off is an amount needed to eliminate a separate critical step required for proper operation of the equipment. The invention is particularly applicable to feed trays for paper handling equipment that that may be detachably mounted to the equipment.

In the case of an adjustable side guide or guides for a feed tray, the present invention will insure that the side guide(s) are automatically set correctly after the side guide(s) are moved to snugly touch the materials. This function greatly simplifies the process of setting the side guide(s) and helps to ensure that the feeder tray operates properly in the process of feeding materials from the tray. By being able to repeatedly and quickly properly position side guide(s) with respect to materials being fed, the productivity of the equipment is increased.

This present invention eliminates the most critical step in adjusting side guides; the need to back the side guides off a specific amount from the edges of the materials being fed. The required relief between each of the side guides and the stack of materials is produced automatically. Additional steps are eliminated, such as using a spacer, or a visual aid to check side guide spacing prior to loading a feed tray with a full stack of materials to be processed.

With the present invention it is not necessary to load the feed tray with a single piece of materials to check the guide spacing. This speeds up the loading of materials to be processed and also facilitates proper operation of the system by less trained operators. The side guides can be correctly set when feed tray is fully loaded in preparation for running the system. The process is simplified, and results in improved reliability and productivity by eliminating the requirement for operator adjustment with the need to take special care with the critical clearance between the materials and the side guides.

An apparatus embodying the present invention includes a moveable member coupled to an adjustable member. The member are coupled such that when the moveable member is moved in a first direction the adjustable member is move in a first direction and when the moveable member is moved in a second direction the adjustable member is moved in a second direction. A belt is coupled to the movable member. Movement of the belt in a first direction moves the moveable member in the first direction and movement of said belt in a second direction moves the moveable member in the second direction. A belt tensioner mechanism is connected to the belt so that when the belt moves in the first direction a biasing force is created that drives said belt to move a controlled amount in the second direction when movement of the belt in the first direction is stopped.

In accordance with an embodiment of the present invention, a materials feed tray includes a first and a second materials side guide. A first rack member is attached to the first materials side guide and a second rack member is attached to the second materials side guide. A gear is mounted to engage the first and the second rack member such that when said gear is rotated in a first direction, the first and the second materials side guides move toward each other and when the gear is rotated in a second direction, the first and the second materials side guides move away form each other. A first pulley is connected to the gear such that when said pulley rotates the gear is caused to rotate. A second pulley is mounted to rotate in a first direction and in a second direction. A belt is mounted around the first and the second pulley. A belt tensioner mechanism is connected to the belt that applies a controlled tension to the belt such that when the second pulley is caused to rotate in the first direction or the second direction, the belt moves and causes the first pulley to rotate. Rotational movement of the second pulley in the first direction moves the belt in a first direction and creates a biasing force in the belt tensioner mechanism to move the belt a controlled amount in a second direction when movement of the belt in said first direction stops.

In yet another embodiment of the present invention, a moveable belt having opposing surfaces is moveable in a first direction and in a second direction. A belt tension member and a clamp member are positioned to engage opposing surfaces of the belt. The tension member is mounted such that the tension member can rotate and move linearly. A first bias member is connected to the tension member and mounted to urge the tension member toward the clamp member and a second bias member mounted to urge the clamp member toward the tension member.

In a mechanism having a belt moveable in a first direction and in a second direction, a method for controlling movement of the belt embodying the present invention includes providing a tensioner arm positioned to engage the belt and biasing the tensioner arm to move in a lateral direction to tension the belt. Biasing is also provide to rotate the tensioner arm to move said belt in a second direction after the belt is moved in the first direction and movement in the first direction is stopped.

BRIEF DESCRIPTION OF THE DRAWINGS

Reference is now made the various figures wherein similar reference numerals designate similar items in the various views and in which.

DETAILED DESCRIPTION OF THE PREFERRED EMBODIMENT

Figure 1:
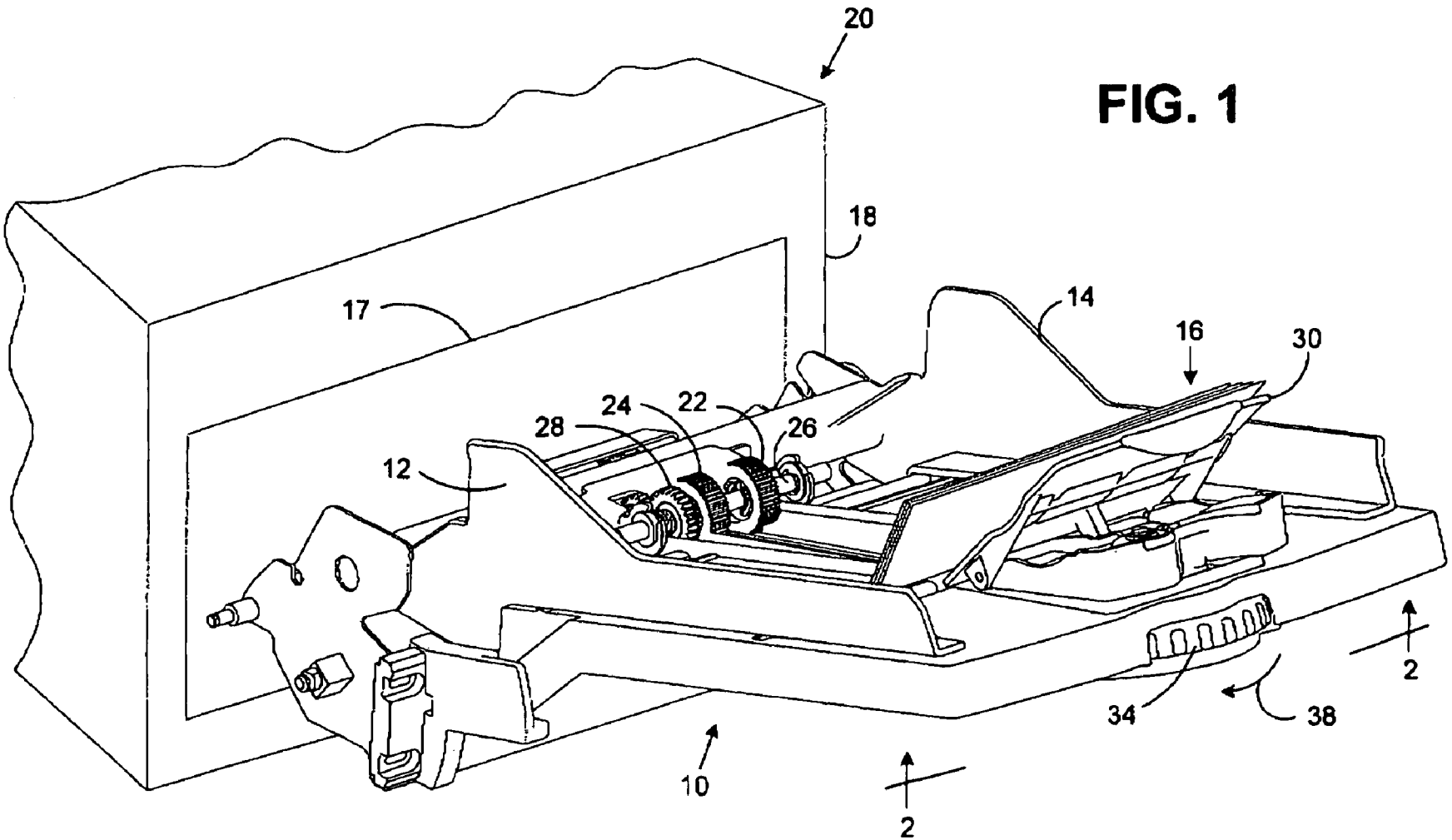
FIG. 1 is a perspective view of a detachable feed tray with self adjusting side guides embodying the present invention; and, FIG. 2 is a view along lines 2-2 of the detachable feed tray shown in FIG. 1 with the top and bottom covers removed and showing only the functional parts associated with the self adjusting side guide mechanism.

Reference is now made to the figures, and more particularly, to FIG. 1. Detachable feed tray 10 has side guides 12 and 14. The feed tray 10 is detachably connected to the separation and feed mechanism 18 of paper handling equipment 20. The side guides 12 and 14 constrain and guide materials such as envelopes 16 loaded in a shingled arrangement into a separation and feed mechanism 18 when the feed tray 10 is connected to the equipment 20. Equipment 20 can be any type of equipment requiring the feeding of materials suitable to be place in a feed tray. Examples of such equipment are inserting system, folding systems, printers, copiers and the like. The separation and feed mechanism 18 may be of standard design, as for example, the feed mechanism employed in the Pitney Bowes tabletop inserter, model F-350.

When the feed tray 10 is connected to equipment 20, the envelopes 16 (or sheets or inserts, as the case may be) are urged toward the separation and feed mechanism 18 by nudgers 22 and 24 mounted on shaft 26. Pinion gear 28 mounted on the shaft engages the separation and feed mechanism 18 which controls the shaft 26 and thus the nudger rollers 22 and 24 to rotate and nudge the envelopes 16 into the separation and feed mechanism 18. A spring biased sled 30 maintains a pressure on the shingled envelopes 16 and pushes the stack of envelopes toward the nuddger rollers 22 and 24 as envelopes are singulated and fed into the equipment 20.

The feed tray 10 can feed various types of materials. The feed tray 10 can be a detachable shingle feed tray as shown in the figures or a stacks type feed tray such as for cut sheets. The various types of materials feed trays can be employed. The feed trays may be detachable or permanently built into the equipment. Shingle and stacks feed trays are adapted to feed a wide variety of materials such as envelopes, cut sheets, folded inserts, pamphlets, booklets, post cards and the like.

Figure 2:
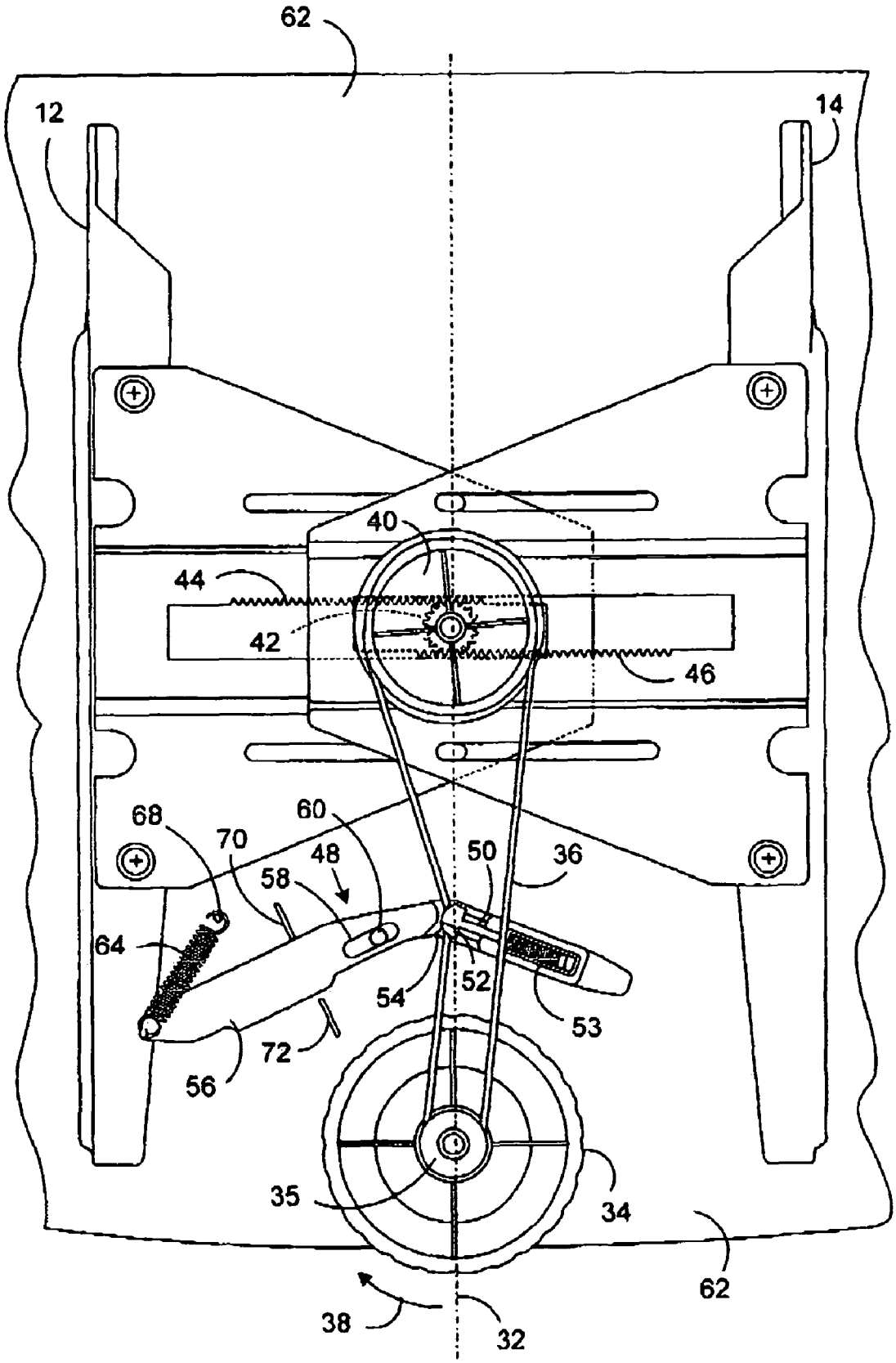

The feeder side guides are controlled to move toward and away from each other along a centerline 32 shown in FIG. 2 by a knob 34. The knob 34 causes a pulley 36 mounted to knob 34 to drive a drive belt 36. When the knob 34 is rotated in a clockwise direction as shown by arrow 38, the side guides 12 and 14 move toward each other. When the knob 34 is rotated in a counter clockwise direction, the side guides 12 and 14 move away from each other.

Drive belt 36 drives a pulley 40 to move an integrally mounted pinion 42. Pinion 42 engages racks 44 and 46 to cause the side guides 12 and 14 to move toward or away from each other, depending on the direction of the rotation of the knob 34 and, thus, the pinion 42. The drive belt 36 moves through a tensioner mechanism shown generally at 48. Tensioner mechanism 48 provides several functions. Tensioner mechanism 48 functions to tension the drive belt 36 so that vibration and other similar effects do not cause the side guides to move during operation of the equipment when knob 34 is not being rotated to move the side guides. Tensioner mechanism 48 provides a controlled tension on the belt 36 to ensure a reliable drive between the knob 34 and the pulley 40. Tensioner mechanism 48 causes the side guides 12 and 14 to automatically back off a controlled amount when the knob 34 is released from movement in the direction to close the side guides. The back off of the two side guides 12 and 14 is a controlled movement of the side guides away form each other. The distance is such that envelopes or other materials be fed from the feed tray will not bind on the sides or be jammed resulting in a failure to feed. The controlled amount of back off depends upon the particular arrangement of the system. A typical range of distance may be approximately 0.5 millimeters to 3.0 millimeters total for both side guides to move away form the side of the materials in the tray. This small distance is sufficient to enable reliable feeding of the materials while appropriately guiding and constraining the materials so they remain aligned and do not skew or become off set as they are moved in the tray toward the separator and feeder mechanism 18.

The tensioner mechanism 48 includes a clamp member 50 which is spring biased by a spring 53 to cause a surface 52 of the clamp member to engage one side of drive belt 36. The other side of the belt 36 is engaged by surface 54 of the tensioner arm 56. The belt 36 is thus clamped between clamp member surface 52 and surface 54 of tensioner arm 56. The clamping force produces a friction force controlling the force required to slip the belt 36 through the surfaces 52 and 54. The friction force to slip the belt through the clamping surfaces must be greater than the force needed to move the belt 36 to open the side guides 12 and 14. The belt can be of any suitable cross section. The surfaces 52 and 54 clamping the belt may be shaped and have surfaces to accommodate different belt materials and belt cross sections such as circular, oval, rectangular, etc.

The tensioner arm 56 includes a slot 58 in which a pivot 60 is captured. The pivot is mounted to the feed tray structure 62. The feed tray structure or frame on which the tensioner mechanism and other parts are mounted will vary according to the specific feed tray design. The tensioner arm 56 is operable to slide and also pivot around pivot 60. The tensioner arm 56 can move in both a linear and rotational manner. The sliding of the tensioner arm 56 along the slot 58 is substantially orthogonal (normal) to the belt 36 span between the pulleys 35 and 40. This insures that the mechanism 48 causes rotation of the tensioner arm 56 and no lateral motion along the slot 58 after the tensioner arm 56 is in tension and has taken up the slack in belt 36 due to the force of spring 64. Other mounting arrangements for the tensioner arm can be employed such as a linkage or flexure that enable both a linear movement and a rotational movement for the tensioner arm. The tensioner arm 56 is biased by a spring 64, which is connected to post 68 on the tray structure 62. The range of motion of the tensioner arm 56 is constrained by stops 70 and 72 and the dimensions and shape of the slot 58. The tensioner arm 56 is shown in FIG. 2 moved against stop 70 and away from stop 72. The tensioner mechanism 48 is arranged such that the mechanism provides a force to tension the belt 36 but the force of the clamping due to surfaces 52 and 54 biased toward each other by action of the respective springs 53 and 64, due to the slot 58, enables the knob 34 to move the belt 36 in either direction.

The tension of the spring 53 and 64 and dimensions of the tensioner arm 56 and clamp member 50 are such that a when the knob 34 is rotated in either direction, the belt 36 will move and drive pulley 40. This allows the side guides 12 and 14 to be moved in and out. When the knob 34 is not being rotated, tensioner arm 56 and clamp member 50 are exerting a force on the belt 36 so that vibrations and the like will not cause the side guides 12 and 14 to move. However, when knob 34 is rotated in a direction to close the side guides 12 and 14, the tensioner arm 56 is caused to move in a direction to tension spring 64. When the knob 34 is released, the clamp surface 52 and the surface 54 of the tensioner arm 56 under action of the spring 64, which is now in increased tension, causes the tensioner arm 56 to move to engage belt 36. In cooperation with clamp member surface 52, the rotational motion of the tensioner arm 56 exerts sufficient force to drive the belt 36 to move. This movement is in a direction and amount that will rotate pulley 40 to back off or open the side guides 12 and 14 a controlled amount. The amount of movement of the side guides 12 and 14 may be in the range previously noted. The specific amount of movement of the side guides 12 and 14 away from each other by this action of tensioner mechanism 48 is a matter of design choice for the particular feed tray and materials involved. The specific amount of movement depends on the dimensions of the parts. The movement enables the side guides 12 and 14 to guide the envelopes or other materials with sufficient clearance so that the materials are moved by the slider 30 toward the nudger rollers 22 and 24 and are thereafter separated and fed into the equipment 20. This action also helps keep the side guides 12 and 14 from opening further after the specific movement caused by the release of the knob 34. Once tensioner arm 56 has moved the side guides 12 and 14 open and is against the stop 70, the side guides are prevented from opening further by media pushing on the side guides, vibration and the like.

As described above, the tensioner mechanism 48 functions to tension the belt 36, providing drag so that the side guides 12 and 14 do not move with vibration and normal handling. The tensioner mechanism 48 also functions to provide the drive to move the side guides 12 and 14 to open a controlled amount, once the knob 34 is released after moving to close the side guides. When the knob 34 is being rotated, tensioner mechanism allows the belt to be moved in either direction and provides a tension so that the belt drives the pulley 40, but with a clamping force that grips the belt 36 so that a minimum force is required to slip the belt relative to the surfaces clamping the belt. As previously noted, various shaped clamping surfaces can be employed. The particular surfaces 52 and 54 are convex and may include ridges to detent the belt if teeth are provided in the belt surface to thereby increase the friction. The particular configuration is a matter of design choice. Based on requirements that the allows the belt 36 to slip past the tensioner arm 56 and clamp member 50 but also be moved by the tensioner arm 56 as described above.

This functionality of the tensioner mechanism is achieved since the tensioner arm 56 has two degrees of freedom of movement. The tensioner arm 56 can translate to tension the belt and can also rotate to move the belt. With the spring 64 connecting the tensioner arm 56 to the feed tray structure, forces on the belt 36 keep the belt taut on the pulleys 36 and 40. This is due to the force of the spring 64 which causes the tensioner arm 56 to have a linear motion. Moreover, since the force of the spring 64 also provides a rotational component on the tensioner arm 56, the tensioner arm 56 can drive the belt 36 to move the control amount. By the force created on the belt by the tensioner arm 56 pulling back on the belt 36, opposite to the direction to drive the side guides 12 and 14 toward one another, the tensioner mechanism 48 drives the side guides open. Since the tensioner arm 56 rotates between the stops 70 and 72, the driving of the side guides 12 and 14 to open is controlled to a preferred displacement.

The side guides 12 and 14 are set by adjusting the guides until both guides snugly contact the materials in the feed tray 10. The tensioner arm spring 64 is energized as the guides are moved in toward the materials, and the tensioner arm 56 is constrained by stop 72. When the knob 34 is released, the tensioner arm spring 64 causes the tensioner arm 56 to pull the belt 36 and to rotate to the opposite stop. This movement of the belt only occurs in one direction. When the knob 34 is rotated to open the side guides, spring 64 is not placed in the additional tension. It is the additional tension on spring 64 that is needed to drive the belt 36 by action of the tensioner arm 56. This controlled rotation of the tensioner arm 56 controls the motion of the side guides 12 and 14, to open a preferred amount, for example, 1.5 mm for sheets and envelopes in removable trays or 0.5-1.0 mm for fixed high capacity envelope feeders. These ranges are within the previously noted range of 0.5 to 3.0 mm. This spacing ensures that the side guides 12 and 14 will prevent excessive skew and off set and also will not pinch the materials so that the materials fail to feed.

It should be recognized that many modifications can be made. For example, the use of the clamp member 50 could be eliminated. The friction between the tensioner arm 56 and the belt 36 can be controlled according to the belt tensioning forces, for example, by wrap the belt producing capstan-friction. The clamp member 50 could also be configured to pinch with a roller, eliminating the additional friction of the wrapped portion of the belt, but providing the forces needed to drive belt 36 via the knob 34. Various types and arrangements of springs and parts may be employed to provide the operation for the tensioner mechanism 48. Accordingly, while the present invention has been described in connection with what is presently considered to be the most practical and preferred embodiments, it is to be understood that the invention is not limited to the disclosed embodiment, but, on the contrary, is intended to cover various modifications and equivalent arrangements included within the spirit and scope of the appended claims.

What is claimed is:

1. An apparatus having a left adjustable member and a right adjustable member, comprising:

a moveable member coupled to said left adjustable member and said right adjustable member such that when said moveable member is rotated in a clockwise direction said left adjustable member and said right adjustable member are moved apart and when said moveable member is moved in a counter clockwise direction said left adjustable member and said right adjustable member are moved closer together; and a belt coupling said movable member to a mechanism, wherein said mechanism converts rotation of said belt into coordinated motion of said left adjustable member and said right adjustable member so that said left adjustable member and said right adjustable member move the same distance in opposite directions wherein said mechanism includes a tensioner member and a clamp member, said tensioner member and said clamp member positioned to engage opposing surfaces of said belt, said tension member moveably mounted such that said tensioner member can rotate and is biased toward said clamp member, so that said tension member causes said left adjustable member and said right adjustable member to back off a controlled amount when said moveable member is released.

2. An apparatus as defined in claim 1 further wherein said tensioner member is further mounted such that said tensioner member can move rotationally.

3. An apparatus as defined in claim 2 further including a first stop member and a second stop member positioned to limit movement of said tensioner member.

4. The apparatus claimed in claim 1, wherein said left adjustable member and said right adjustable member automatically back off a controlled amount when said moveable member is released.

5. The apparatus claimed in claim 1, wherein said apparatus is a paper feed tray.

* * * * *